United States Patent [19]

Chaplin

[11] Patent Number: 4,489,441

[45] Date of Patent: Dec. 18, 1984

[54] METHOD AND APPARATUS FOR CANCELLING VIBRATION

[75] Inventor: George B. B. Chaplin, Colchester, England

[73] Assignee: Sound Attenuators Limited, Essex, United Kingdom

[21] Appl. No.: 540,905

[22] PCT Filed: Nov. 21, 1980

[86] PCT No.: PCT/GB80/00201

§ 371 Date Jul, 15. 1981

§ 102(e) Date Jul. 15, 1981

[87] PCT Pub. No.: WO 81/01480

PCT Pub. Date: May 28,1981

Related U.S. Application Data

[63] Continuation of Ser. No. 285,104, Jul. 15, 1981, abandoned.

[30] Foreign Application Priority Data

Nov. 21, 1979 [GB] United Kingdom ..... 7940325
Jan. 14, 1980 [GB] United Kingdom ..... 8001155

[51] Int. Cl.[3] ..... G10K 11/16; H04R 1/28
[52] U.S. Cl. ..... 381/71; 381/94
[58] Field of Search ..... 181/206; 381/71, 73, 381/94

[56] References Cited

U.S. PATENT DOCUMENTS

| | | | |
|---|---|---|---|
| 2,983,790 | 5/1961 | Olson | 179/1 P |
| 3,826,870 | 7/1974 | Wurm et al. | 179/1 P |
| 4,044,203 | 8/1977 | Swinbanks | 179/1 P |
| 4,122,303 | 10/1978 | Chaplin et al. | 179/1 P |
| 4,153,815 | 5/1979 | Chaplin et al. | 179/1 P |

FOREIGN PATENT DOCUMENTS 1548362 7/1979 United Kingdom .

*Primary Examiner*—Gene Z. Rubinson
*Assistant Examiner*—James L. Dwyer
*Attorney, Agent, or Firm*—Dann, Dorfman, Herrell and Skillman

[57] ABSTRACT

Improved method and apparatus for the nulling of a primary vibration by the "active" method, based on the "virtual earth" system in which the output of a loudspeaker (3′) is continually controlled by a feedback loop (1′, 2′ 3′) to maintain a null at a microphone (1′) disposed adjacent to the loudspeaker. In accordance with the invention the loop (1′, 2′, 3′) is used as a generator for the correct waveform of the secondary vibration required to null the primary vibration, the amplitude at which the secondary vibration is projected into the primary vibration being increased to move the null point to the far field of the loudspeaker (3′).

9 Claims, 16 Drawing Figures

METHOD AND APPARATUS FOR CANCELLING VIBRATION

This a continuation of Ser. No. 285,104, filed 7/15/81 which is now abandoned.

TECHNICAL FIELD

This invention relates to an improved method and apparatus for the nulling of a primary vibration (e.g. noise in a gas) by the "active" method, i.e. the generation of a cancelling vibration (e.g. anti-noise) which coacts with the primary vibration (e.g. noise) to at least partly null it in a selected location.

BACKGROUND ART

Various proposals have been made for generation of effective "anti-noise" signals and reference may be made to the specifications of U.S. Pat. Nos. 4122303 and 4153815.

This invention is concerned with improvements in a simple system for active noise cancellation which operates in the frequency domain and is sometimes referred to as the "virtual earth" system. This system is described for instance in the specification of U.S. Pat. No. 2983790 (Olson). The "virtual earth" system can be used to create a quiet zone in the vicinity of a microphone disposed in a sound field, by locating a loudspeaker closely adjacent to the microphone (e.g. some 10 cms away) and coupling the microphone and loudspeaker into a loop circuit producing an overall gain greater than unity and a 180° phase reversal. This known "virtual earth" system operates by continually controlling the output from the loudspeaker so that it nulls the sound field at the microphone.

The known arrangement is shown in the first figure of the accompanying drawings to be discussed hereafter from the discussion of that figure, the limitations of the known system will become evident.

The present invention seeks to increase the distance over which a "virtual earth" system is effective without reducing the frequency range over which the "virtual earth" system can operate.

DISCLOSURE OF INVENTION

According to one aspect of the invention a method of attenuating, in a desired location, a vibration entering that location from a primary source of vibration which method comprises injecting into that location a nulling vibration of such waveform and amplitude that it will at least partially cancel the effect of the primary vibration in the desired location, the waveform being generated in an amplifying/phaseshifting feedback loop linking a vibration-sensing transducer and a closely proximate vibration-transmitting transducer, is characterised in that the waveform generated in the loop is amplified and used to generate a secondary vibration which is fed into the location to produce a null at a position remote from the vibration-sensing transducer of the loop.

The known "virtual earth" system uses the feedback loop as an automatic waveform generator which in a simple manner produces the correct secondary vibration for producing the "virtual earth" at the location of the vibration-sensing transducer.

By this invention it has been appreciated that the role of the feedback loop to produce the correct waveform, can be separated from the role of the loop to produce the correct amplitude. Thus by using the loop in its waveform shaping role and "over amplifying" the waveform signal, it is possible to move the "virtual earth" into the far field of the vibration-transmitting transducer without bringing the frequency at which the loop will oscillate into the working range of an active attenuation system (e.g. up to a few hundred Hertz).

The vibration-transmitting transducer used in the feedback loop can be used to produce the secondary vibration generating the "virtual earth" in the said location or the waveform fed to this transducer can be amplified and fed to a similar adjacent vibration-transmitting transducer, whose output is projected into the location.

According to a further aspect of the invention, apparatus for nulling a primary vibration in a selected location by using a specially generated secondary vibration fed to the location, which apparatus comprises a vibration-receiving transducer sensing the primary vibration, a vibration-transmitting transducer located adjacent to the vibration-receiving transducer and connected therewith in a phase-inverting feedback loop and is characterised in that a second vibration-receiving transducer is located in the said location, means is provided to control the amplitude of a vibration generated from the waveform appearing in said feedback loop so that it is projected to the vicinity of said second transducer and there produces, with the primary vibration, a null of vibration energy.

Control of the amplitude of the projected vibration may be effected manually to achieve a null in the signal sensed by the second vibration-receiving transducer or the amplitude control can be effected automatically.

The invention can be used to attenuate any vibration but has particular application in the generation of anti-noise signals to reduce the ambient sound levels in working environments (such as vehicle cabs, offices or factories) and in living areas (such as those near airports or motorways).

BRIEF DESCRIPTION OF DRAWINGS

The invention will now be described, by way of example, with reference to the accompanying drawings, in which.

The microphone 1 is normally placed as close as possible to the loudspeaker 3 in order to reduce the overall delay round the feedback loop, and hence increase the frequency at which the circuit ceases to be effective because of oscillation.

The circuit will oscillate when the combined delays around the circuit are equivalent to a 180° phase shift at a particular frequency, and the overall "gain" is greater than unity.

To prevent oscillation, one or more filters would have to be included in the circuit, in order to reduce the gain to unity at, or before, the frequency ($f_{max}$) where the phase shift reaches 180°. The degree of cancellation is a function of the gain of the circuit, and hence only becomes useful at a frequency significantly lower than $f_{max}$, since, in practice, an active attenuation system operates in the frequency range up to a few hundred Hertz, it is important for the gain of the feedback loop to be high in this range and thus, the value of $f_{max}$ needs to e at least 1000 Hertz (and preferably at least 2000 Hertz).

In a given situation, $f_{max}$ can be increased as the distance l is decreased, and hence it is desirable to make l as small as is practically possible. Thus known "virtual earth" systems have worked with a distance l of no more than ten centimeters and often of the order of 1 centimeter.

It will be noted that in the known system the "virtual earth" is at the location of the microphone 1 and is thus very close to the loudspeaker 3.

Figure 2:
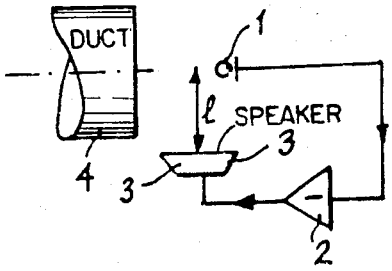
FIG. 2 (Prior Art)
FIG. 2 is a schematic representation of a prior-art system applied to a duct.

However, in many situations, such as when a loudspeaker is required for cancelling the noise at the outlet of an IC engine exhaust pipe, or a ventilating duct, the "virtual earth" is required near the axis of the pipe or duct, and not near the wall where the loudspeaker 3 would desirably be situated. FIG. 2 illustrates such a situation, the duct or pipe being shown at 4. To move the "virtual earth" out to the axis of the duct or pipe 4 significantly more power is required in the cancelling waveform projected from the loudspeaker 3 than is required if the "virtual earth" is close to the loudspeaker 3. Further, the increase in l, reduces the frequency at which oscillation will occur.

BEST MODE FOR CARRYING OUT THE INVENTION

The main objective of this invention is to move the "virtual earth" away from the loudspeaker 3 and thereby achieve a null at the desired position (usually for optimum cancelling) whilst preventing the earlier onset of oscillation by enabling the microphone 1 to be placed other than at the "virtual earth" (usually by keeping the microphone 1 as close as possible to the loudspeaker 3).

Separating the "virtual earth" from the position of the microphone in the manner proposed by this invention, has a further advantage of enabling the microphone to be located in a hospitable environment when the "virtual earth" may be in a highly hostile environment (e.g. hostile to the microphone so far as temperature or turbulence conditions may be concerned).

The invention thus provides a means whereby the noise power injected by the loudspeaker 3 is increased, whilst still maintaining a feedback loop with sufficient gain, at the frequencies of interest, to force the loudspeaker 3 to inject the correct waveshape of the nulling vibration for achieving cancellation of the primary vibration at the "virtual earth".

Thus, the feedback loop can be regarded as a filter, which automatically compensates for any imperfections in the loudspeaker or other parts of the loop or as a waveform generator which automatically gets the waveform right.

The invention resides in separating the waveform shaping facility of a prior art "virtual earth" system from the amplitude-setting facility of the feedback loop whereby the "virtual earth" can be moved to positions other than that occupied by the microphone 1.

Figure 3:
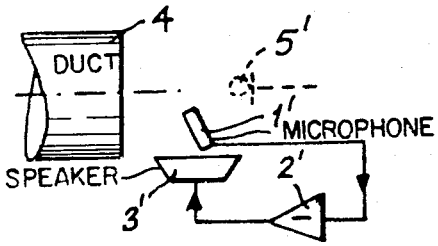
FIG. 3 is a schematic representation of the invention applied to the cancelling of noise at one end of a duct.

FIG. 3 shows one simple way in which the method of the invention can be applied to cancelling the output noise from the duct 4. In this case the microphone 1' is a directional open-backed microphone (e.g. a loudspeaker) which is sensitive to vibrations normal to its large area flat faces but is insensitive to vibrations normal thereto. With the microphone 1' angled to the axis of the duct as shown in FIG. 3 it will be sensitive to both the primary noise leaving the duct 4 and the output of the loudspeaker 3'. The angle of the directional microphone can be adjusted, either manually or automatically (using for example, a "residual" noise microphone shown dotted at 5') in such a way that:

(a) The amplitude of the secondary noise injected by the loudspeaker 3' is correct for optimum cancellation.

(b) There is sufficient feedback round the microphone (1')/amplifier (2')/loudspeaker (3')/loop to ensure the correct waveshape for the secondary noise to effect the cancellation of the primary noise at the point 5'.

The directional microphone 1' could take many forms, e.g.

Figure 4:
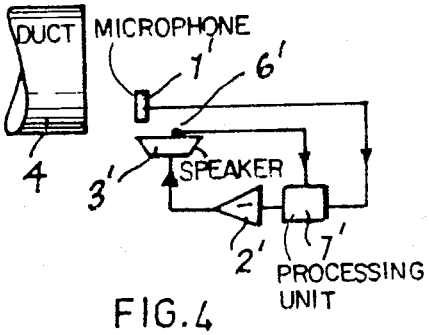
FIG. 4 illustrates a further arrangement for cancelling duct-borne noise, FIGS. 5 and 6 indicate how a pair of microphones can be used to control the feedback loop in a system according to the invention, FIGS. 7, 8 and 10 indicate how duct-borne noises can be cancelled with the method of the invention.

(1) An open-backed microphone (sensitive to wave direction, as well as amplitude), together with a suitably connected omni-directional microphone or any suitable array of microphones or their equivalent. Ratioing could be either manual or electronic.

or (2) Two separate directional microphones, one of which responds only, or largely, to the secondary signal (or anti-noise), and creates a feedback loop which is sufficient to compensate for loudspeaker defects, etc., and another which responds only, or largely, to the primary noise and injects this signal into an appropiate part of the feedback loop in such a way that an amplified cancellation version is emitted by the loudspeaker 3'. The amplitude of the latter can be controlled manually, or for example, by the use of the residual microphone at 5'.

or (3) an arrangement shown in FIG. 4 could be used where the feedback loop is completed by, for example, an accelerometer 6' attached to the loudspeaker diaphragm and feeds its output into a suitable processing circuit 7'. The accelerometer 6' is of course, sensitive to the loudspeaker performance alone, and is insensitive to the primary noise in the duct 4'. The directional microphone 1' senses the primary noise in the duct.

Figure 5:
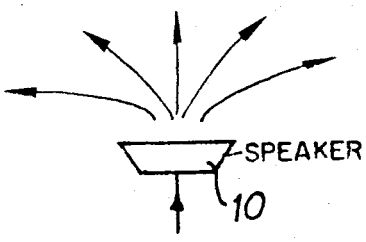

FIG. 5 shows a loudspeaker 10 radiating a noise signal which is at least partly omni-directional, so that the field strength (or sound pressure) decreases with distance from the loudspeaker (from a point source, the inverse square law would apply).

Thus, microphones placed at increasing distances from the loudspeaker 10 would receive decreasing sound pressure intensities.

Figure 6:
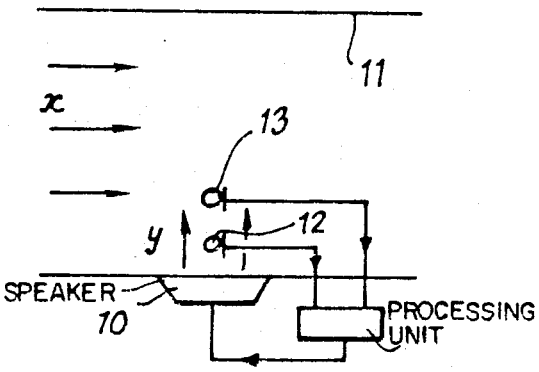

FIG. 6 shows this situation in a duct 11, and it can be seen that the microphones 12 and 13 receive substantially the same intensity of the primary signal, but different intensities of the secondary signal coming from the loudspeaker 10.

If the primary noise waveform is designated x, and the secondary or cancelling waveform y, then microphone 12 will receive a composite signal of $a_1x+n_1y$ and microphone 13 will receive a composite signal of $a_2x+n_2y$, (where $n_2$ will be less than $n_1$, but $a_1$ will be very similar to $a_2$). Thus by processing these signals (e.g. a direct subtraction) the x and y components can be separated out. The signal y can then be applied to the feedback loop, and x can then treat the loop as a "perfect" cancellation injector.

The processing of the signals from the microphones 12 and 13 can be manual, or self-adaptive using, for example, a residual microphone.

Figure 7:
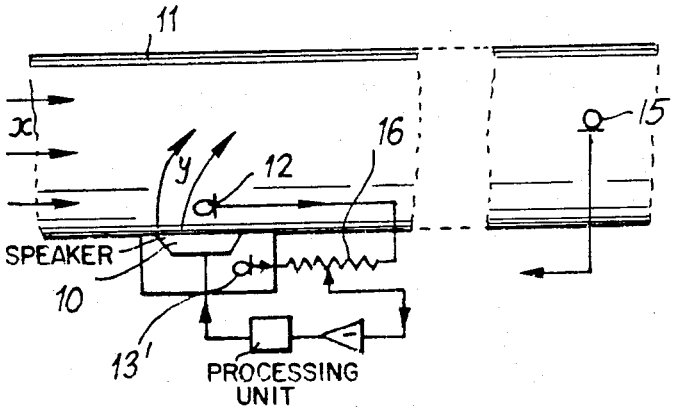

Another configuration for separating out the x and y signals is shown in FIG. 7. The second microphone 13' is placed inside the cabinet of the loudspeaker, where the signal is predominantly y, and the outputs from the two microphones 12, 13', which are now anti-phase, are added in the correct ratio to produce a null at a sensing microphone 15 downstream in the duct. The output from the microphone 15 can be used to control the ratio of the proportional divider 16.

Figure 8:
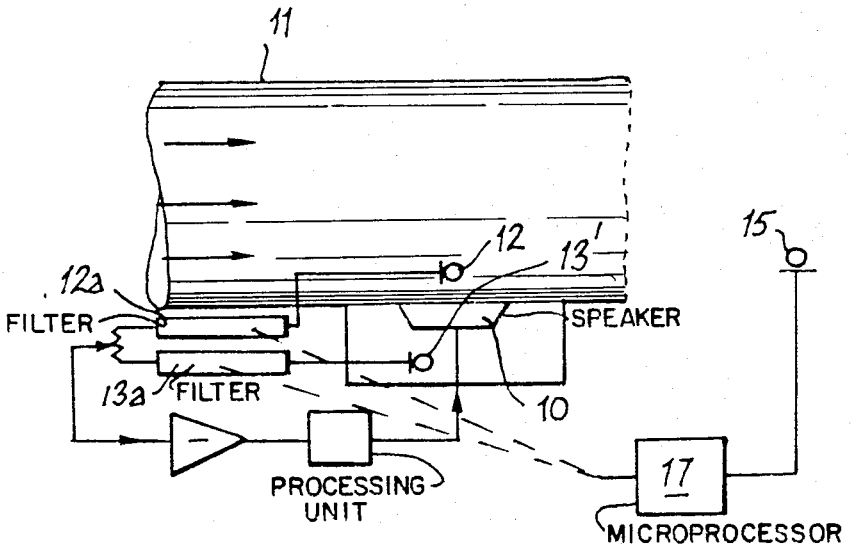

In the various configurations of the two microphones, in which the proportions of the x and y signals are different, the acoustic environment of each microphone is also likely to be different, and so a simple ratioing of the two signals is not likely to produce an optimum null at 15. FIG. 8 shows how the signals from the microphones 12 and 13' can be processed in a filter (12*a*, 13*a*) to compensate for the acoustic emvironments. The filter adjustments could be made manually for example, by observing the output of the microphone 15, or automatically by, for example, a microprocessor 17 which adjusts the filters in an adaptive manner to produce an optimum null at 15.

One embodiment of FIG. 8 might use transversal filters in which the acoustic waveforms from the two microphones are sampled at a relatively high rate, and either in analogue or digital form, moved along the filter, as a function of time, each sample contributing a variable amount to the filter output. The adjustment of these variables could be accomplished manually or by the microprocessor, using a variety of algorithms, on either power or waveform information, designed to adapt the filters to produce an optimum null at 15. Furthermore, these filters cna automatically produce the correct ratioing and addition or subtraction, and can also perform the function of the low pass filter if required, and of adjustment of loop again.

Figure 9:
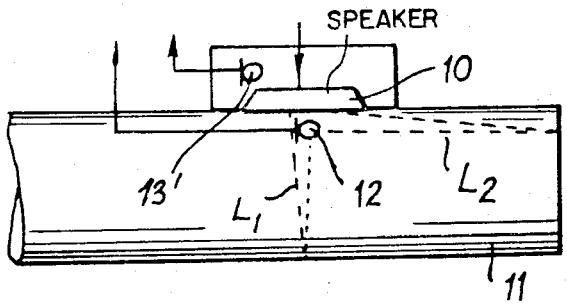
FIG. 9 illustrates some reflections which may occur in a duct.

Additionally, if they are of sufficient length (in terms of time) they can compensate for unwanted lower frequency modes of feedback, such as the acoustic paths $L_1$ and $L_2$ shown in FIG. 9.

Figure 10:
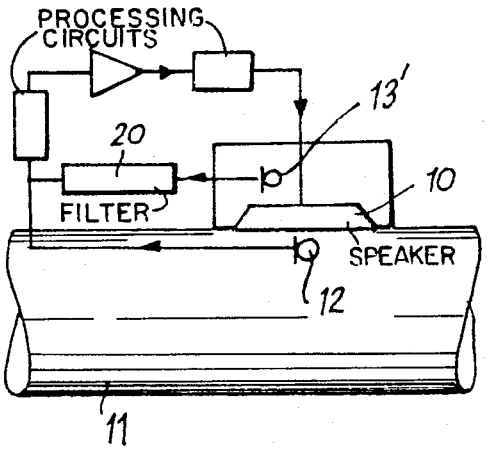

The filters do not have to be symmetrical, as in FIG. 8, but might more economically have a different configuration, such as that shown in FIG. 10, where filter 20 compensates for the difference between the environments of the two microphones 12, 13'.

Figure 11:
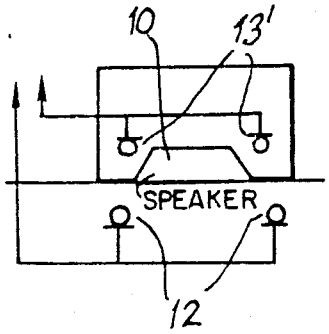
FIG. 11 shows an alternative arrangement of sensing microphones near a speaker.

The interaction of the correct signal for cancellation, might be improved by replacing each of the microphones by two (or more) as illustrated in FIG. 11.

Furthmore, a plurality of "virtual earth" systems according to the invention can be used, either in the same region of the duct to produce better symmetry, or in cascade (i.e. spaced-apart along the duct).

The predominant loudspeaker sound pressure signal (y), could be derived in other ways than a microphone or an accelerometer mounted on the loudspeaker cone, by, for example, measuring the EMF across the coil of the loudspeaker.

Figure 12:
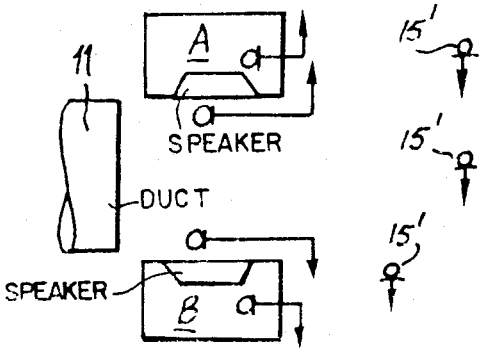
FIG. 12 shows an arrangement for cancelling noise from the end of a duct.

FIG. 12 shows one or more cancellation systems placed at the end of a duct 11, with one or more sensing microphones 15' monitoring or adjusting the degree of cancellation. This could be particularly applicable in the case of a hostile environment such as an engine exhaust. If measuring residual noise power, the sensing microphones 15' could be connected together, or used singly or in groups to control each "virtual earth" system A and B. One adaption strategy would be to multiplex the adjustment of each element of the filters in such a way that all the systems would be adapted together, thus reducing unwanted interaction between the systems.

If the adaption strategy uses sound pressure waveform information, rather than power, then it may be necessary to have a delay, or memory, to store the signal information on each element of a filter being adapted, so that it can be used to modify the configuration of the elements at a later time when the noise which caused the signal information has caused a response in the appropriate signal microphone. The elements can then be adjusted, based on the residual signal from the sensing microphone, and the stored information.

Figure 1:
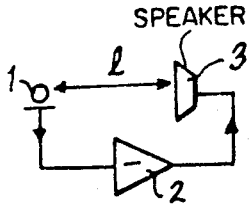
FIG. 1 (Prior Art)
FIG. 1 is a schematic representation of a prior-art "virtual earth" system.
Figure 13:
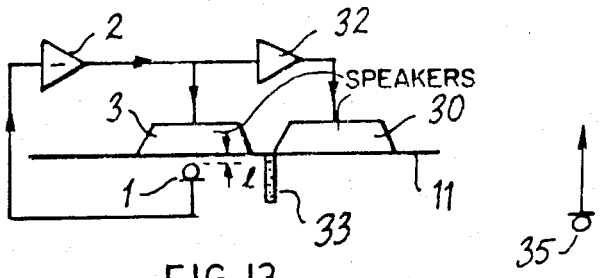
FIG. 13 is a schematic representation of how a "virtual earth" system can be used as a waveform generator.

FIG. 13 illustrates a further arrangement in which the set-up of FIG. 1 is used as a waveform generator to drive a second loudspeaker 30 via a power amplifier 32, the gain of which is set by a sensing microphone 35 in the far sound field. If the loudspeakers 3 and 30 are similar, and the spacing l is very small (e.g. less than 1 cm) a good nulling performance is obtained up to a frequency limit of some 300 Hertz.

In practice it is desirable to isolate the output of the loudspeaker 30 from the microphone 1 and this can be done by suitably angling the loudspeaker 30 so that its output is directed away from the microphone 1, or by interposing an acoustic barrier 33 between the loudspeaker 30 and the microphone 1.

When an arrangement such as that shown in FIG. 13 is used in a duct, the loudspeaker 30 can be located on a duct wall opposite to the loudspeaker 3 and an acoustic barrier can be interposed between the two loudspeakers.

When a directional microphone is used (such as the microphone 1' in FIGS. 3 and 4) it may be useful to arrange for the adjustment of the direction of peak sensitivity to be adjustable electronically and this can be done with a suitable array of omni-directional microphones ganged together in known ways. Having a facility for varying the direction of peak sensitivity instantly by an electronic process enables the direction to be altered as a function of frequency and this can be particularly useful in the case of a directional array used in a duct.

Figure 14:
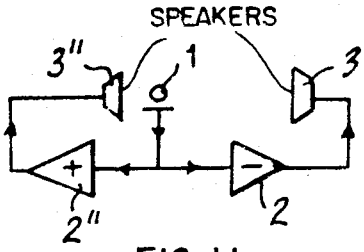
FIG. 14 shows an alternative way of modifying FIG. 1 to provide a system according to the invention.

FIG. 14 shows a modification of FIG. 1 in which the "virtual earth" is moved away from the position of the microphone 1 by increasing the gain of the microphone by reducing the negative feedback in the loop 1, 2, 3. To achieve this, a second loudspeaker 3'' is employed (preferaby of higher quality—e.g. an electrostatic type) coupled to the microphone 1 via a positive gain amplifier 2'' so that a larger proportion of the signal received by the microphone 1 comes from the loudspeaker 3'' than comes from the loudspeaker 3.

Figure 15:
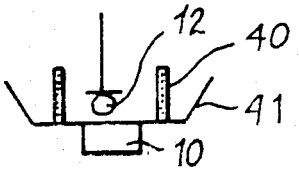
FIG. 15 shows an alternative way of mounting the microphone near a speaker.

The microphone 12 can be shielded from "cone break-up" effects.One of the causes of instability which limits the gain to unity at $f_{max}$ is the phase shift caused when the cone of the loudspeaker 10 ceases to act as a piston, but "breaks up" into modes. In FIG. 15, the microphone 12 is surrounded by a cylinder 40 which absorbs or reflects the break-up radiation from the outer annulus 41 of the speaker cone.

Figure 16:
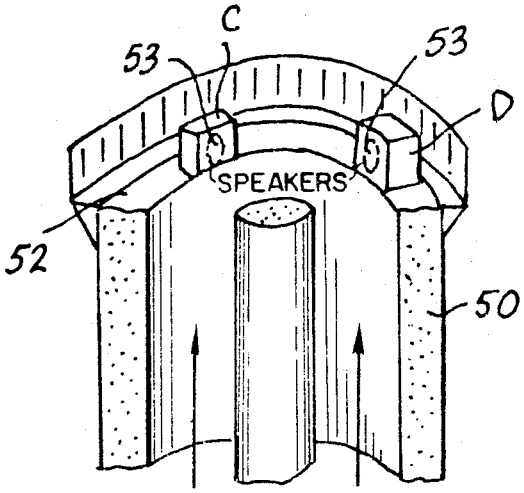
FIG. 16 shows how the invention can be applied to a silencing tower of a gas turbine Referring first to FIG. 1, it is well known (see U.S. Pat. No. 2983790-Olson) that a noise "null" ( a "virual earth") can be obtained at a microphone 1 by connecting it with an amplifier 2 and a loudspeaker 3 as is shown in FIG. 1.

FIG. 16 illustrates a further arrangement in which the system of the invention is used to reduce the noise dissipated from the output of a silencing tower 50 of a gas turbine. Concentric splitters 51 are used to absorb the higher frequency noise in the tower and a series of "virtual earth" systems C, D as described above are positioned around a catwalk 52 at the top of the tower 50 to remove the lower frequencies (e.g. up to 250 Hertz). Tube microphones (not shown are placed in the gas stream just below the catwalk and are connected by appropriate filters to the loudspeakers 53 of the systems C, D.

Thus, it will be appreciated that the invention has achieved a separation of the twin functions of a known "virtual earth" system either by using a directional microphone (or an equivalent array of microphones achieving a selective effect) or by separating the primary vibration from the nulling vibration, following by remixing in a different ratio, such that the loudspeaker attempts to cancel a higher power of primary vibration than is actually incident at the microphone (or microphones).

I claim:

1. A method of attenuating, in a desired location, a primary vibration entering that location from a primary source of vibration, which method comprises injecting into that location a secondary vibration of such waveform shape and amplitude that it will at least partially cancel the effect of the primary vibration in the desired location, the secondary vibration being generated by an amplifying/phase-shifting feedback loop linking a vibration-sensing transducer means, receiving both the secondary and primary vibrations and a closely proximate vibration-transmitting transducer means serving as the source of the secondary vibration, wherein the vibration-sensing transducer means is a directional microphone arranged to monitor both the primary and the secondary vibrations but to be less sensitive to the generated secondary vibration than to the primary vibration and the output from the vibration-transmitting transducer means is adjusted so that (a) the waveform shape of the secondary vibration generated by the said loop is the waveform shape which would be capable of cancelling the primary vibration at the location of the directional microphone and (b) the amplitude of said waveform is such that the at least partial cancellation produced by coaction between the secondary and primary vibrations, occurs at a position within the location which is spaced from the vibration-transmitting transducer means by a distance greater than the distance between the said directional microphone and the vibration-transmitting transducer means.

2. A method of attenuating, in a desired location, a primary vibration entering that location from a primary source of vibration, which method comprises injecting into that location a secondary vibration of such waveform shape and amplitude that it will at least partially cancel the effect of the primary vibration in the desired location, the secondry vibration being generated by an amplifying/ phase-shifting feedback loop, linking a vibration-sensing transducer means receiving both the secondary and primary vibrations and a closely proximate vibration-transmitting transducer means serving as the source of the secondary vibration, wherein the the vibration-sensing transducer means comprises a pair of microphones one of which is more sensitive to the secondary vibration than to the primary vibration than is the other of the pair, the output from the vibration-transmitting transducer means being adjusted so that (a) the waveform shape of the secondary vibration generated by the said loop is the waveform shape which would be capable of cancelling the primary vibration at the location of the said other microphone of the pair and (b) the amplitude of said waveform is such that the at least partial cancellation, produced by coaction between the secondary and primary vibrations, occurs at a position within the location which is spaced a greater distance from the vibration-transmitting transducer means than the distance between said other microphone and the said vibration-transmitting transducer means.

3. A method as claimed in claim 2, in which the amplitude of the secondary vibration is adjusted to produce a null at a further vibration-sensing transducer disposed in the said location.

4. A method as claimed in claim 3, in which the amplitude of the secondary vibration is automatically adapted on a trial and error basis to achieve a minimum output from said further vibration-sensing transducer.

5. A method as claimed in claim 1, in which the angle of the directional microphone is set relative to the vibration-transmitting transducer means and the primary source is adjusted to achieve optimum cancellation at the said position within the said location.

6. A method as claimed in claim 2, characterised in that both microphones of the pair receive both primary and secondary vibrations, but said other microphone of the pair is further from the vibration-transmitting transducer than is said one microphone of the pair.

7. A method as claimed in claim 2, wherein said one microphone of the pair is located inside a housing of the vibration-transmitting transducer means where it is sensibly screened from the primary vibration.

8. Apparatus for nulling a primary vibration in a selected location by using a specifically generated secondary vibration fed to the location, which apparatus comprises a vibration-sensing transducer means to sense both the primary and secondary vibrations, a vibration-transmitting transducer feeding the secondary vibration to the vibration-sensing transducer means and connected therewith in a phase-inverting feedback loop, characterised in that said vibration-sensing transducer means comprising two vibration-sensing transducers provided to sense the primary and secondary vibrations adjacent to the vibration-transmitting transducer in two different ratios, and means is provided to control the amplitude of a vibration generated by the vibration-transmitting transducer so that it is projected into the said location and there produces, with the primary vibration, a null of vibration energy, the means to control the amplitude of the secondary vibration transmitted to the said location including means to adjust the ratio if the signals fed from the two vibration-sensing transducers to the feedback loop.

9. Apparatus as claimed in claim 8, in which one of the vibration-sensing transducers is positioned where it will sense substantially only the secondary vibration.

* * * * *